US006928696B2

(12) United States Patent
Wartman

(10) Patent No.: US 6,928,696 B2
(45) Date of Patent: Aug. 16, 2005

(54) ACTUATOR FOR IMPROVING SEAL FOR OVERHEAD DOORS

(76) Inventor: Robert F. Wartman, 1224 Commonwealth Ave. SW., Marietta, GA (US) 30064

( * ) Notice: Subject to any disclaimer, the term of this patent is extended or adjusted under 35 U.S.C. 154(b) by 13 days.

(21) Appl. No.: 10/625,443

(22) Filed: Jul. 23, 2003

(65) Prior Publication Data

US 2005/0015926 A1 Jan. 27, 2005

(51) Int. Cl.[7] ..... A47H 15/00; E05D 15/06; E05F 1/00

(52) U.S. Cl. ..... 16/99; 16/97; 16/106; 16/107; 16/90; 16/91; 16/96 R; 16/DIG. 1; 49/197; 49/209; 160/209

(58) Field of Search ..... 16/99, 97, 98, 16/106, 107, 90, 91 R, 96 R, DIG. 1; 160/209; 49/197, 209

(56) References Cited

U.S. PATENT DOCUMENTS

| | | | | | |
|---|---|---|---|---|---|
| 1,985,976 | A | * | 1/1935 | Clark | 160/209 |
| 2,166,746 | A | * | 7/1939 | Bartel | 160/191 |
| 2,827,114 | A | | 3/1958 | Stroup | |
| 2,871,932 | A | * | 2/1959 | Stroup | 160/40 |
| 4,119,133 | A | * | 10/1978 | Wolf | 160/209 |
| 4,120,072 | A | * | 10/1978 | Hormann | 16/87 R |
| 4,643,239 | A | * | 2/1987 | Wentzel | 160/201 |
| 4,800,618 | A | | 1/1989 | Putz | |
| 4,957,301 | A | | 9/1990 | Clay, Jr. et al. | |
| 5,435,104 | A | * | 7/1995 | Dietrich | 49/493.1 |
| 5,659,926 | A | * | 8/1997 | Dietrich | 16/94 R |
| 6,047,761 | A | * | 4/2000 | Jaehnen et al. | 160/201 |
| 6,463,988 | B1 | * | 10/2002 | Mullet et al. | 160/201 |

FOREIGN PATENT DOCUMENTS

| | | | | |
|---|---|---|---|---|
| EP | 1114908 | A2 * | 7/2001 | E05D/15/16 |
| SE | 8602819 | A * | 12/1987 | E05D/15/16 |

* cited by examiner

*Primary Examiner*—Chuck Mah
(74) *Attorney, Agent, or Firm*—Smith Frohwein Tempel Greenlee Blaha LLC; Gregory Scott Smith

(57) ABSTRACT

The invention includes a clasp that can be mounted to the roller track of an overhead door and a shim that can be mounted to the overhead door or the shaft of the roller. The clasp includes a portion for attaching to the roller track and a blocking portion that is secured in proximate location to the inner surface of the overhead door. When the overhead door is in a closed position, the shim and the blocking portion are engaged thereby encouraging the overhead door towards the door frame. Multiple clasp and shim assemblies can be mounted to the overhead door to improve the seal between the overhead door and the door frame.

20 Claims, 6 Drawing Sheets

ACTUATOR FOR IMPROVING SEAL FOR OVERHEAD DOORS

FIELD OF THE INVENTION

The present invention relates to attachments for overhead doors and, more particularly, to an actuator for biasing an overhead door towards the door jam when the overhead door is in a closed position.

BACKGROUND

Overhead doors, also referred to as roll-up doors, are commonly used on trucks, trailers and similar commercial-type vehicles, as well as on garages and warehouses. The overhead doors are generally made up of multiple panels; however, some simply use a single panel. The movement of an overhead door between and open and closed position is generally controlled by the use of rollers and rails or tracks. A typical overhead door will utilize a series of side mounted rollers with the stem end of the roller being mounted on the inside face of the door and the roller being situated within the rail or track.

To move the door from the closed to the open position, a force is applied to the door to encourage the rollers to traverse the railing. The railings are generally shaped like an upside down "L" with a curved corner so that when the door is in the open position, the top portion of the rail holds the weight of the door. Often times, a spring mechanism is also used to help provide lift to the door when moving from the closed to the open position and to provide speed control when moving the door from the open to the closed position.

During the opening and closing of the overhead door, the door must be able to move freely to prevent an overhead door from binding with the door jam. This characteristic demands that the fit between the overhead door and the door frame or jam to be adjusted with a degree of looseness. Thus there is some play or leeway between the closed door and the door jam. This play results in causing a loose seal between the overhead door and the door jam. This is true even when the door jam or frame includes a weather strip that is mounted to the door jam.

Although necessary in current overhead door designs, the looseness of the seal between the door and the door jam is undesirable for several reasons. One such reason is that the loose seal is energy inefficient. Conditioned air can escape through the loose seal. In addition, the loose seal can allow undesirable objects or elements, such as rain, snow, sleet, leaves, insects, animals, dust and pollutants to enter into the closed area. These conditions are even more prevalent when wind, applying pressure to the door, pushes the door inward. Such inward pressure increases the gap between the door and the door jam. Another reason the loose seal is undesirable is that it can impose a security risk. A loosely sealed door may invite a perpetrator to attempt to breach the overhead door, as well as aid in the perpetrator's ability to breach the overhead door.

Thus, there is a need in the art for method to provide a more secure seal between an overhead door and a door jam when the overhead door is in a closed position. Several techniques have been introduced, such as the device described in U.S. Pat. No. 4,800,618, to address this need; however, the present invention discloses advantages over these techniques that a reunique and novel. More particularly, the present state of the art does not include a technique to address the above-described problems while also having the characteristics of being easy to install without the use of any tools, simplistic in design so as to reduce cost and complexity in manufacturing, and durable.

Accordingly, there is a need in the art for an apparatus that effectively seals, or limits the looseness of the seal between a closed overhead door and the door jam, that is durable, and that can be quickly and easily installed. Further, there is a need in the art for such a device to be easily removed for repair or replacement. Finally, there is a need in the art for such a device that readily permits relative vertical movement between the facing of the overhead door and the door jam without substantial impediment, when and if desired.

SUMMARY OF THE INVENTION

The present invention provides a solution to the aforementioned problems by enabling the overhead door to have a loose fit when the overhead door is being moved between the open and closed positions, while forcing the door tightly against the door jam when the door is in the completely closed position. Advantageously, the present invention can be easily and quickly installed on existing overhead door designs without the need for any tools. In general, the present invention includes one or more sets of two piece components that snap onto the existing hardware and are held in place by friction. Thus, no mounting hardware is required.

In one embodiment of the invention, two sets of the components can be applied to one central hinge point of the overhead door for standard security or improved sealing.

In another embodiment of the present invention, multiple sets can be applied, one set to each hinge point on each side (left and right) of the overhead door, for maximum security and/or sealing.

More specifically, the invention includes two components. One component is a shim that is applied to the stem of the roller. The other component is a clasp that includes a block for engaging the shim. The clasp is attached to the rail at the resting point of the roller when the overhead door is in the closed position. When the overhead door is in the closed position, the block, held in place by the clasp, engages the shim and encourages the overhead door towards the door jam. In embodiments that include multiple sets of the components, the shims are designed in a manner to allow all shims to pass all blocks until the door is at the closed position. In the closed position, the shims and the blocks associated with the shims will engage, thereby encouraging the door towards the door jam.

Other features and advantages of the present invention will become apparent upon reading the following detailed description of the embodiments with the accompanying drawings and appended claims.

DETAILED DESCRIPTION OF THE INVENTION

Figure 1:
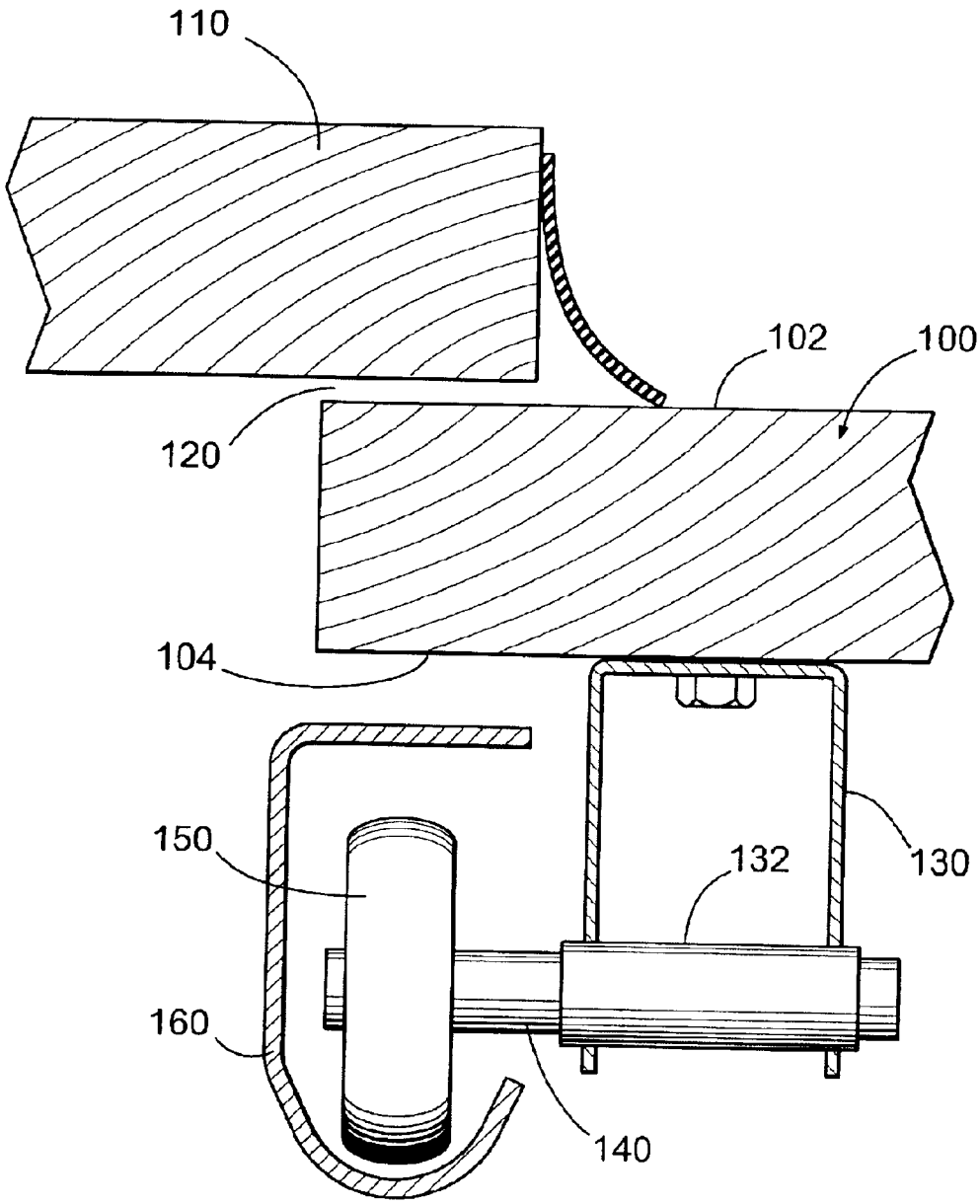
FIG. 1 is a sectional view of a current design for an overhead door utilizing a guide roller and roller track system.

Referring now to the drawings, in which like numerals refer to like elements throughout the several views, exemplary embodiments of the present invention are described.

FIG. 1 is a sectional view of a current design for an overhead door utilizing a guide roller and rail system. A sectional view of a portion of an overhead door panel 100 is shown in proximity to a sectional view of a portion of a door frame 110. The outside surface 102 of the overhead door panel 100 is positioned in a loose fitting manner in proximity to the door frame 110 leaving a gap 120 between the two. A roller shaft bracket 130 is mounted to the inside surface 104 of the overhead door panel 100. The cylindrical sleeve 132 of the roller shaft bracket 130 houses the roller shaft 140. A guide roller 150 is attached to the roller shaft 140 in a manner known in the art to allow the guide roller 150 to freely rotate. In a typical embodiment, the roller shaft 140 is held in place by inserting the roller shaft 140 into a cylindrical sleeve 132 that is attached to or integral to the roller shaft bracket 130. A roller track 160 is mounted to the door frame 110 in proximity to the overhead door panel 100 so that the guide roller 150 resides in the interior of the roller track 160.

Figure 2:
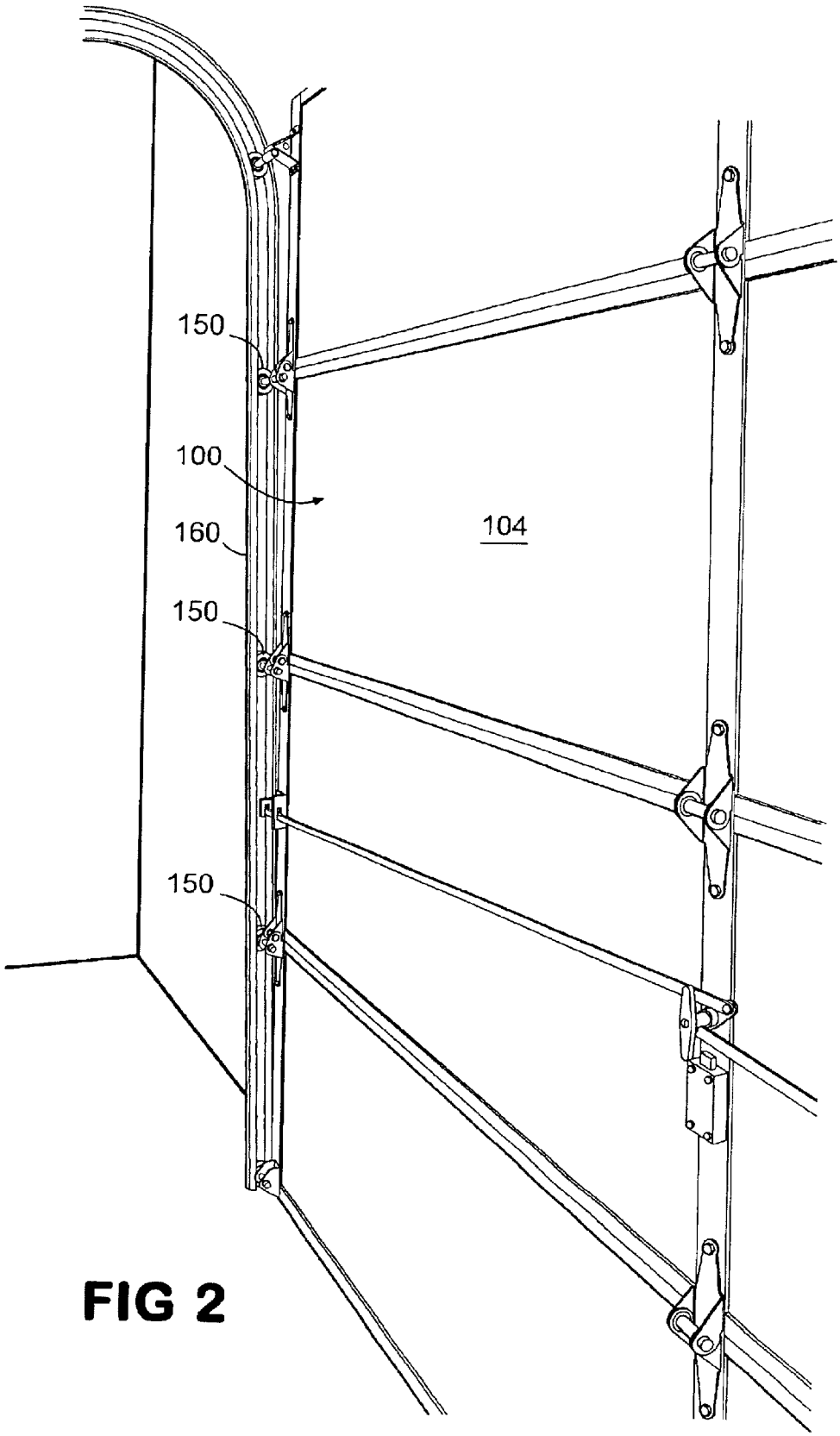
FIG. 2 is a perspective drawing of a current design for an overhead door utilizing a guide roller and roller track system.

FIG. 2 is a perspective drawing of a current design for an overhead door utilizing a guide roller and roller track system. As is known in the art, the overhead door 100 can be moved from a closed position to an open position by applying upward force to the overhead door 100 in either a pushing or pulling configuration. The guide rollers 150 within the roller track 160 control the movement of the overhead door 100.

Figure 3:
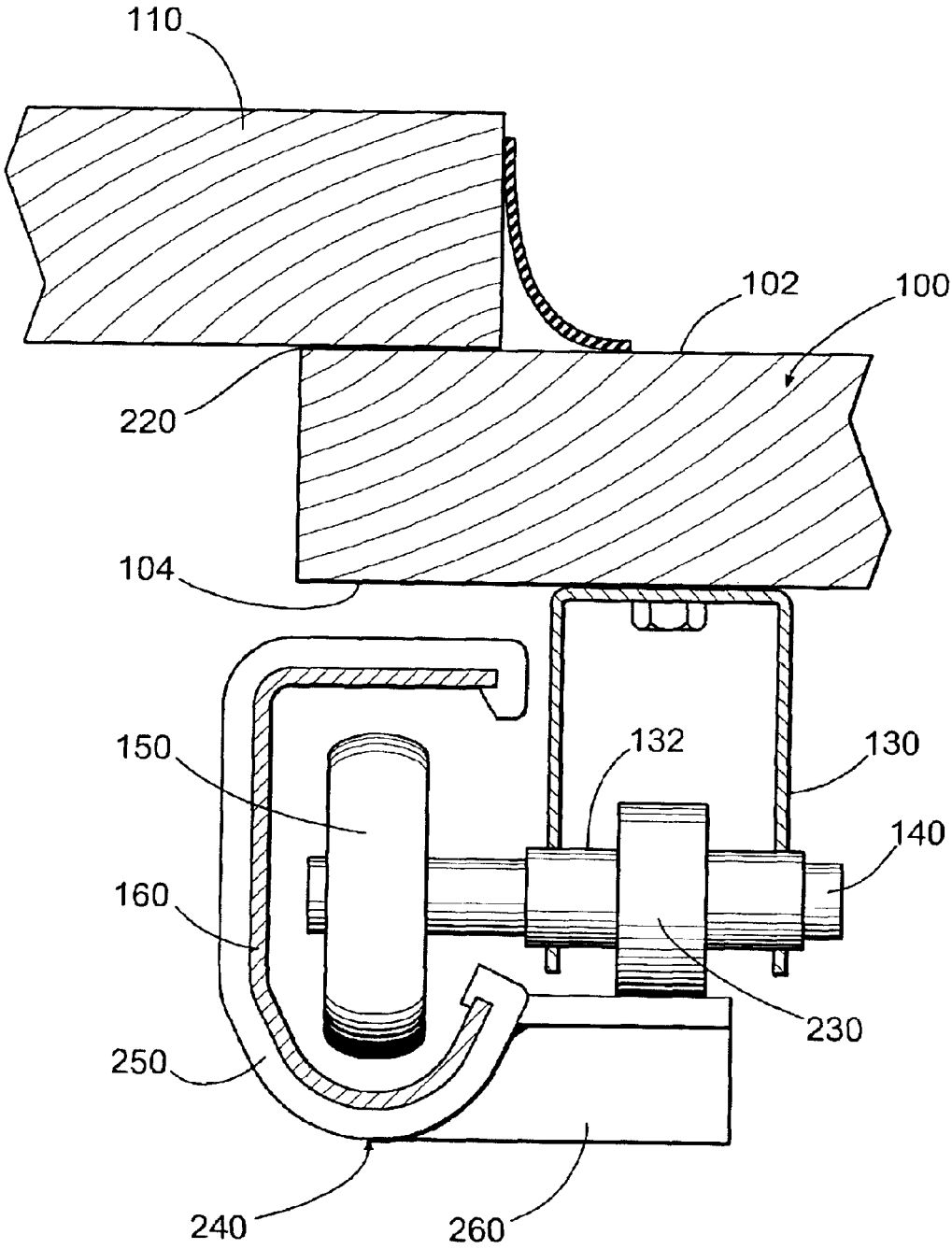
FIG. 3 is a sectional view of an embodiment of the present invention installed on a current design for an overhead door utilizing a guide roller and roller track system.

FIG. 3 is a sectional view of an embodiment of the present invention installed on a current design for an overhead door utilizing a guide roller and roller track system. The illustrated embodiment includes a circular shim 230 and a roller track clasp 240. The circular shim 230 is shown as being attached to the cylindrical sleeve 132 of the roller shaft bracket 130. The roller track clasp 240 includes a roller track clasping portion 250 and a block portion 260. The roller track clasping portion is shown as being clasped to the outer surface of the roller track 160. The block portion 260 is engaged with the circular shim 230 thereby encouraging the overhead door panel 100 towards the door frame 110. This embodiment of the present invention operates to decrease the size of the gap 220 between the outer surface 102 of the overhead door panel 100 and the door frame 110.

Figure 4:
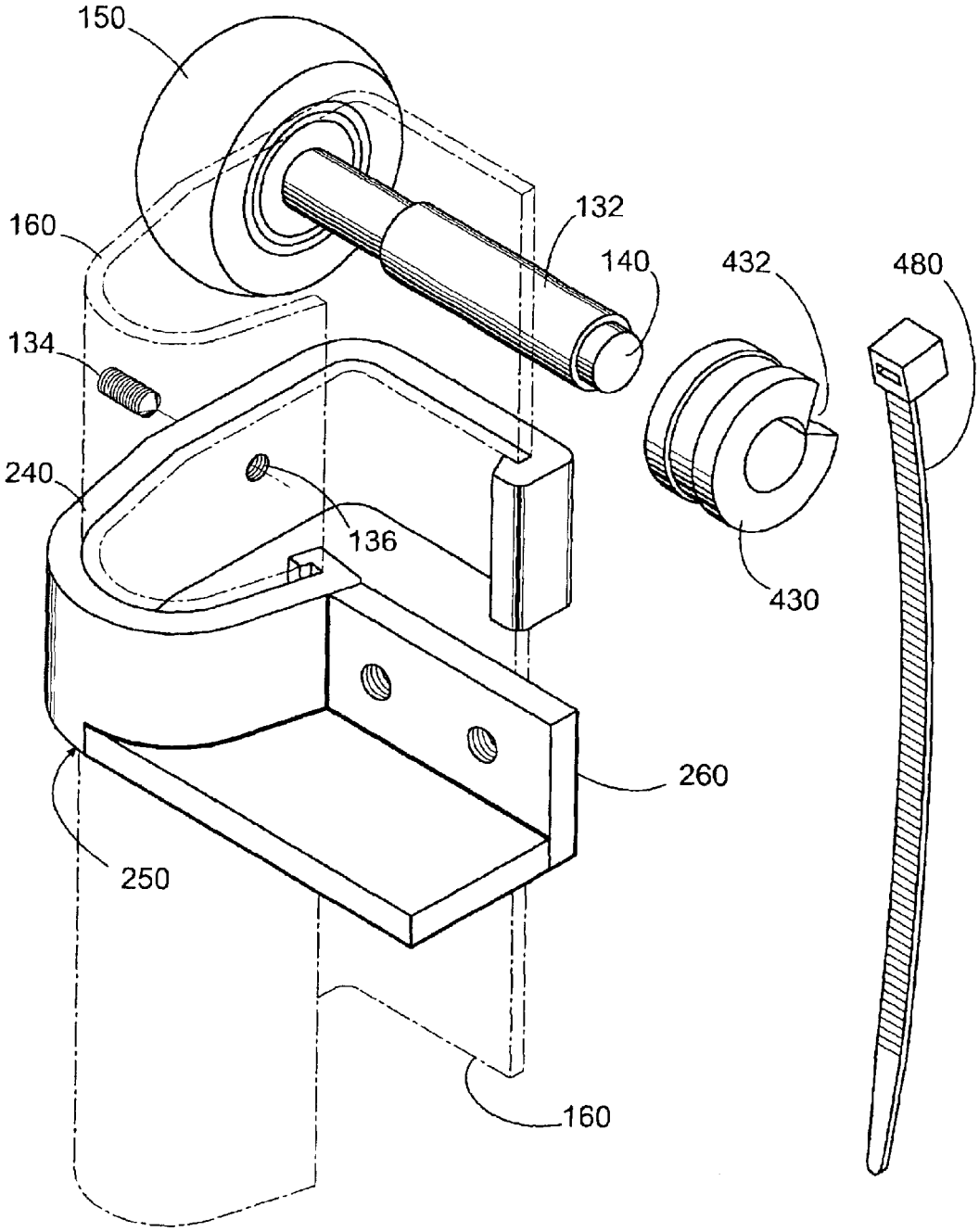
FIG. 4 is a view of one embodiment of the circular shim.

FIG. 4 is a view of one embodiment of the circular shim. The circular shim 430 can be manufactured of a variety of materials including metal, rubber and durable plastic material and can include a gap 432. To install the circular shim 430 onto cylindrical sleeve 132 of the roller shaft bracket 130, the circular shim 430 is forced open at the gap 432 and slid over the cylindrical sleeve 132 of the roller shaft bracket 130. In one embodiment, the circular shim 430 can be secured in position using a fastener, such as wire tie 480. In this embodiment, the circular shim 430 can include an indentation around the outer surface for receiving and holding the wire tie 480 in place and the wire tie can be securely mounted around the circular shim 430. The present invention also anticipates other methods for attaching the circular shim, including but not limited to attaching the shim directly to the roller shaft 140, to other portions of the roller shaft bracket 130 and to the door panel and the present invention should not be limited to any particular method or structure. In fact, the illustrated embodiment is provided simply for purposes of example. In addition, it will also be appreciated that the shim does not have to be circular but instead, could have many other shapes. What is important is that a shim is positioned in such a manner as to engage the block portion 260 of the clasp 240. Although the preferred embodiment of the present invention utilizes a snug fit and friction to hold the clasp 240 in position, it is also anticipated that some embodiments could utilize some additional fastening or securing means further prevent movement of the clasp 240 in relationship to the rail 160. One such embodiment is shown as a threaded hole 136 that receives a screw 134. In operation, the screw 136 can be screwed into the threaded hole 136 in a manner that the tip end of the screw 134 comes into contact with the outer edge of the rail 160 and thereby secures the clasp 240 into position.

In one embodiment of the invention, one clasp 240 can be mounted onto the roller track 160 at the closed resting position of one roller shaft 140 on opposite sides (left and right) of the overhead door panel 100. In this embodiment, when the overhead door is in the closed position, the present invention operates to force the overhead panel 100 towards the door frame 110 and decrease the size of the gap between the two.

Figure 5:
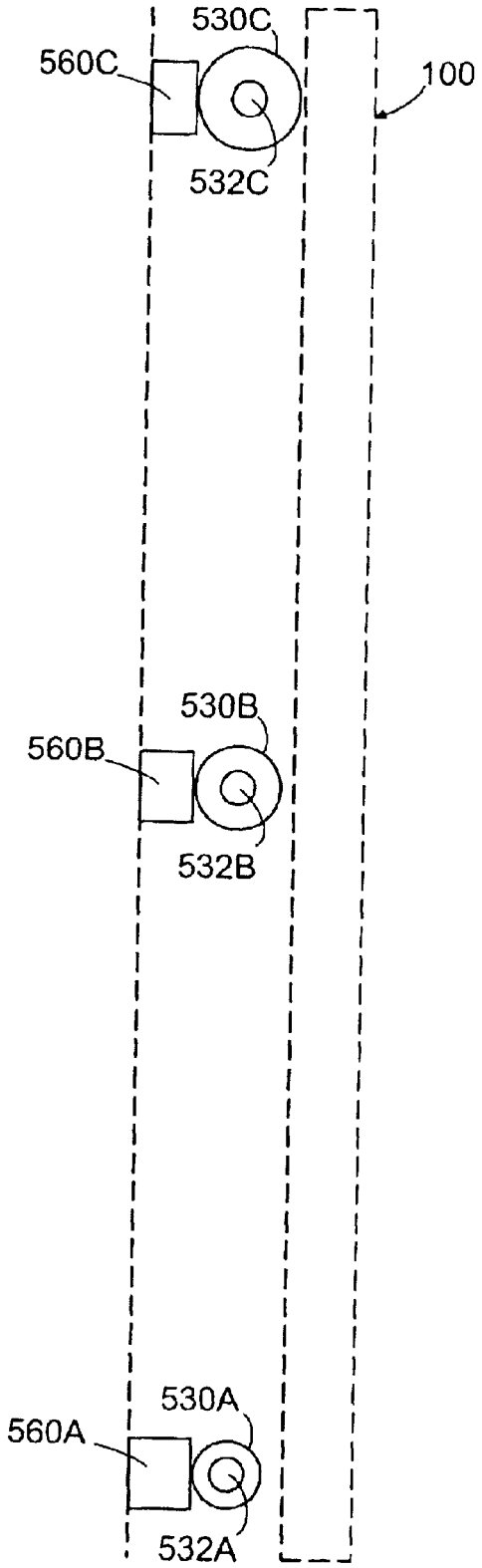
FIG. 5 is a diagram illustrating the use of varying thicknesses for the circular shim.

In another embodiment of the invention, multiple clasps can be mounted onto the roller track 160 in proximity to two or more of the roller shafts 140. In this embodiment of the present invention, the shim attached to the roller shaft 140 will vary in thickness. FIG. 5 is a diagram illustrating the use of varying thicknesses for the circular shim. When multiple shims are utilized, as the overhead door 100 moves between the open and closed positions, the shims could potentially come in contact with the block portions 260 of the clasps 240. Such action could result in binding the overhead door 100 and preventing the movement of the door or damaging the shims or clasps. To overcome this problem, the present invention utilizes shims of various thicknesses. FIG. 5 illustrates this embodiment of the invention with three roller shafts mounted within three cylindrical sleeves 532A, 533B and 534C. Those skilled in the art will appreciate that the use of three roller shafts is simply for illustrative purposes only and this aspect of the present invention can be used for any number of roller shafts. A small-diameter shim 530A is positioned on the cylindrical sleeve 532A that is closest to the bottom of the overhead door panel. A larger-diameter shim 530B is placed over the cylindrical sleeve 532B in the middle position. The largest-diameter shim 530C is placed over the cylindrical sleeve 532C that is closest to the top of the overhead door panel.

FIG. 5 also illustrates three block portions 560A, 560B and 560C2. In the illustrated embodiment, the block portions are shown as being staggered in their position in association with the shims. When the overhead door is in the closed position, the shims 530A, 530B and 530C are respectively engaged with the block portions 560A, 560B and 560C thereby encouraging the overhead door panel towards the door frame 100 (not shown here). As the overhead door panel is moved from the closed position towards the open position, the staggered block portions allow the shims of less thickness to freely pass without binding the overhead door.

Figure 6:
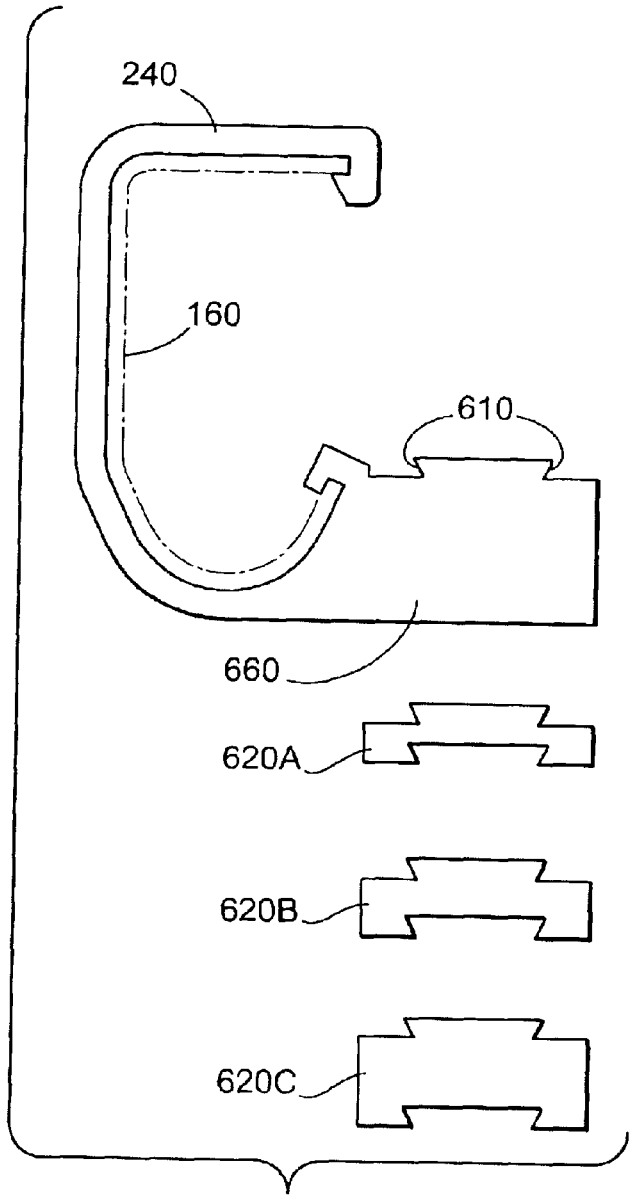
FIG. 6 is a sectional view of one embodiment of the clasps that advantageously allows the block portion to be adjusted in a staggered manner.

FIG. 6 is a sectional view of one embodiment of the clasps that advantageously allows the block portion to be adjusted in a staggered manner. In this embodiment of the invention, the block portion includes a receiving means 610 that is suitably designed to receive inserts 620. Three such inserts are illustrated (620A–C); however, it will be appreciated that any number of inserts could be utilized. In the illustrated embodiment, the receiving means 610 is dovetailed. The inserts 620 are "mail" and "female" dovetailed and can be slid into the receiving means 610 individually, or combined for more varied total thickness. The inserts 620A–C are shown as having various thicknesses. Thus, this embodiment of this aspect of the present invention advantageously allows the block portion 660 to be easily staggered to meet the requirements of the multiple clasp embodiment illustrated in FIG. 5. It should be appreciated that the receiving means 610 and the inserts 620 can take on several configurations and the dovetailed configuration is simply one embodiment anticipated by the present invention.

Figure 7:
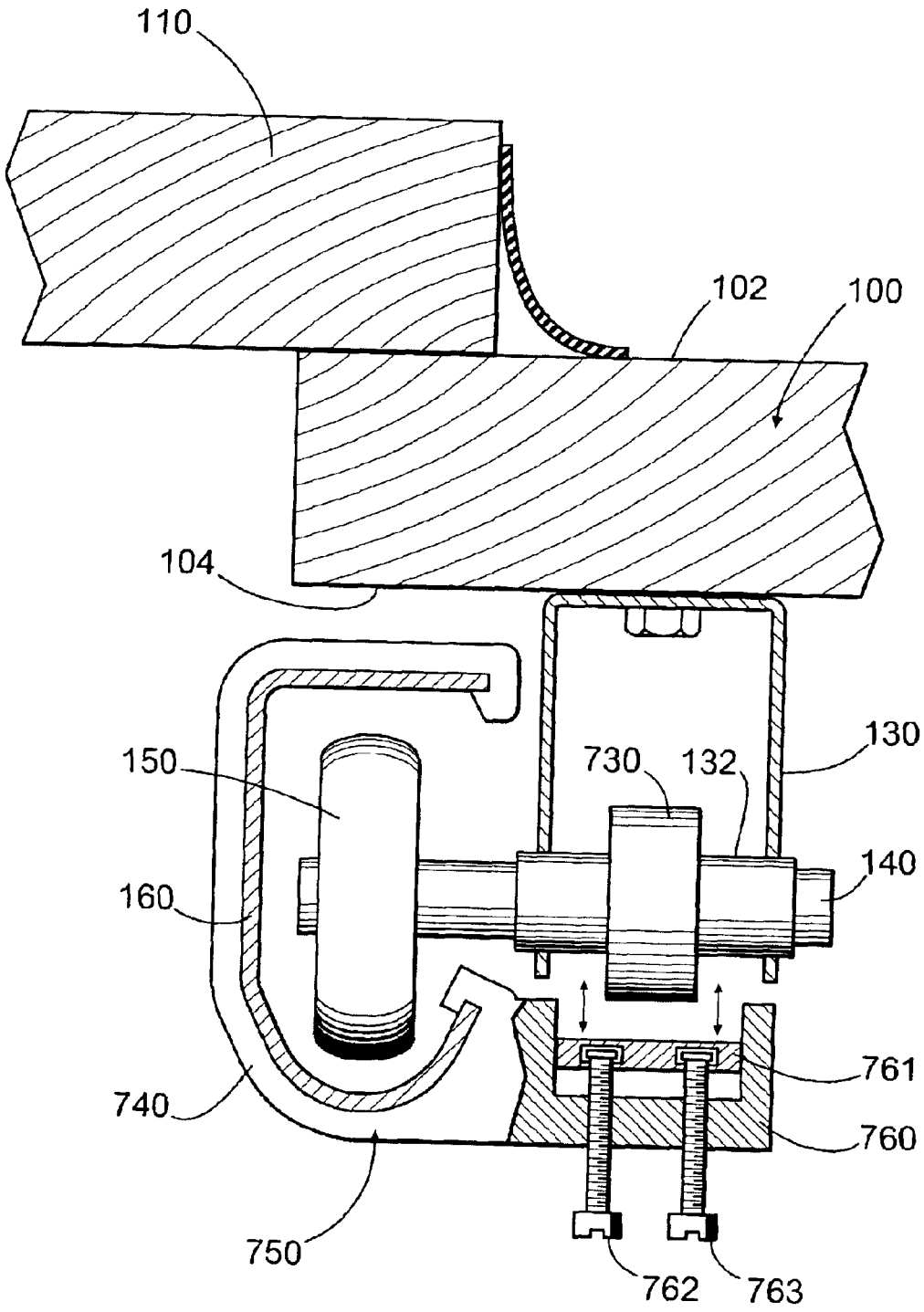
FIG. 7 is a sectional view of another embodiment of the present invention.

FIG. 7 is a sectional view of another embodiment of the present invention. In this embodiment of the present invention, the clasp 740 includes a clasping portion 750 and a block portion 760. The block portion 760 further includes an adjustable member 761 and adjusting screws 762 and 763. In this embodiment of the invention, the staggering of the block portion can be provided by adjusting the adjusting screws 762 and 763 to move the adjustable member 761. In addition, this embodiment, as well as the embodiments anticipated and illustrated in FIG. 6, adjustments can be made to maximize the effectiveness of the engagement of the shims with the block portions.

The present invention contemplates that many changes and modifications may be made. For example, the particular size, shape and configuration of the components are not deemed critical, and may be changed or varied. Indeed, the shim may be alternatively mounted on the overhead door panel in a manner to engage the block portion. While polyvinylchloride is a preferred material because techniques exist to cause one portion to be relatively-hard and another portion to be relatively-soft, other materials, or materials of the same hardness or different degrees of hardness, may be readily substituted. The various components of the invention have been described as being mounted to existing overhead door designs but it will also be appreciated that the components can be formed integrally with the overhead door system or separately, as desired. The invention is also not limited to use in sealing the vertical side space between an overhead door and a frame. If desired, it may be used to seal the overhead or top gap between the door and frame, or the gap between other relatively-movable surfaces.

The invention disclosed herein is particularly adapted for use between the substantially-parallel facing surfaces of a multiple-panel roll-up door, when in its vertical (i.e., lowered or closed) position, and the vertical portion of an associated support frame. Such doors are commonly used on trucks, trailers, and similar commercial-type vehicles, as well as garages and warehouses. The facing surfaces of each door panel and the associated support frame are generally free to move horizontally toward and away from one another (e.g., attributable to horizontal fore-and-aft relative movement between the frame and the overhead door), and are also adapted to move vertically relative to one another in substantially-parallel planes when the door is opened and closed.

It should be appreciated that the shimming function can be accomplished by having staggered sizes on the block portions of the clasp and/or staggered sizes on the circular shims mounted to the roller shaft.

In the description and claims, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons skilled in the art. The scope of the invention is limited only by the following claims.

What is claimed is:

1. A structure for encouraging the outside face of an overhead door towards a door frame, the overhead door being an integral part of a roller track assembly, the structure comprising the combination of:

a roller track clasp having a roller track clasping portion that can be attached onto a roller track at a position approximate to a roller shaft and guide roller assembly when the overhead door is in a first position, the roller shaft and guide roller assembly comprising a roller mounted to a roller shaft, the roller shaft being mounted to the overhead door and the roller residing in the interior of the roller track, and a block portion facing the interior surface of the overhead door; and a shim that is mounted onto the roller shaft in such a manner that the shim and the block portion are engaged when the overhead door is in the first position, thereby encouraging the overhead door towards the door frame.

2. The structure of claim 1, wherein the roller track clasp is attached onto the roller track by being snapped onto the roller track.

3. The structure of claim 1, wherein the roller track clasp is attached onto the roller track by being snapped onto the roller track and is held in position by friction.

4. The structure of claim 1, wherein the roller track clasp is attached onto the roller track by being snapped onto the roller track and can be easily removed.

5. The structure of claim 1, wherein the block portion of the roller track clasp is adjustable to alter the proximity of the block portion relative to the interior surface of the overhead door.

6. The structure claim 5, wherein the block portion of the roller track clasp includes a receiving means operable to receive one of a plurality of inserts, each of the plurality of inserts having a varying thickness.

7. The structure of claim 5, wherein the block portion of the roller track clasp includes an adjustable portion and an adjusting means operable to alter the proximity of the adjustable portion relative to the interior surface of the overhead door.

8. The structure of claim 1, wherein when the overhead door is moved from the first position, the block portion and the shim are disengaged.

9. The structure of claim 1, wherein the shim is integral to the roller shaft of the roller shaft and guide roller assembly.

10. The structure of claim 1, wherein the shim is attachable to the roller shaft of the roller shaft and guide roller assembly.

11. A structure for encouraging the outside face of an overhead door towards the facing of a door frame, the overhead door being an integral part of a roller track assembly which includes a roller track and a roller shaft and guide roller assembly, the roller shaft and guide roller assembly comprising a roller mounted to a roller shaft, the roller shaft being mounted to the overhead door and the roller residing in the interior of the roller track, the structure comprising the combination of:

a roller track clasp having a roller track clasping portion that can be attached onto a roller track and a block portion facing the interior surface of the overhead door; and a shim that is mounted onto the overhead door and independent of the roller shaft in such a manner that when the overhead door is in a first position, the shim engages to the block portion of the roller track clasp, thereby encouraging the overhead door towards the door frame.

12. The structure of claim 11, wherein the shim is attached to the overhead door.

13. The structure of claim 11, wherein a roller shaft and guide roller assembly comprising a roller mounted to a roller shaft is fixedly attached to the overhead door, the roller resides in the interior of the roller track, and the shim is attached to the roller shaft of the roller shaft and guide roller assembly.

14. The structure of claim 11, wherein the block portion of the roller track clasp is adjustable to alter the proximity of the block portion relative to the interior surface of the overhead door.

15. A method for encouraging the outside face of an overhead door towards the facing of a door frame, the overhead door being an integral part of a roller track assembly and, on opposing ends of the overhead door, a plurality of roller shaft and guide roller assemblies are fixedly attached thereto, each roller shaft and guide roller assembly comprising a roller mounted to a roller shaft, the method comprising:

attaching one or more roller track clasps to the roller track assembly, the roller track clasp having a roller track clasping portion and a block portion, the roller track clasps being attached in such a manner that each roller track clasp is associated with one of the plurality of roller shaft and guide roller assemblies by being attached in proximate location with one of the plurality of roller shaft and guide roller assemblies when the overhead door is in a first position; and attaching a shim to the roller shaft and guide roller assembly that is associated with a roller track clasp, the shim being attached in such a manner that the shim and the block portion are engaged when the overhead door is in the first position, thereby encouraging the overhead door towards the door frame.

16. The method of claim 15, wherein the plurality of roller shaft and guide roller assemblies on one end of the overhead door includes a first and second roller shaft and guide roller assembly that are in line relative to each other and associated relatively with a first and second roller track clasp, so that when the overhead door is moved to a second position, the first roller shaft and guide roller assembly moves away from the first roller track clasp and passes by the second roller track clasp, and the step of attaching a shim to the roller shaft and guide roller assembly further comprises the steps of: attaching a shim having a first thickness to the first roller shaft and guide roller assembly and attaching a shim having a second thickness to the second roller shaft guide roller assembly, the first thickness being less than the second thickness.

17. The method of claim 15, wherein the block portion of the roller track clasp is adjustable to alter the proximity of the block portion relative to the interior surface of the overhead door and the step of attaching one or more roller track clasps to the roller track assembly further comprises the steps of: altering the proximity of the block portion of the first roller track clasp to a first setting; and altering the proximity of the block portion of the second roller track clasp to a second setting, whereby the first setting is more proximate to the interior surface of the overhead door than the second setting.

18. The method of claim 15, wherein the block portion of the roller track clasp includes a receiving member for receiving one of a plurality of varying inserts with each insert having a varying thickness, and the step of altering the proximity of the block portion of the first roller track clasp to the first setting further comprises inserting an insert having a first thickness and the step of altering the proximity of the block portion of the second roller track clasp to the second setting further comprises inserting an insert having a second thickness, wherein the first thickness is less than the second thickness.

19. The method of claim 15, wherein the block portion of the roller track clasp includes an adjustable member and an adjusting means, and the step of altering the proximity of the block portion of the first and second roller track clasp to the first and second settings further comprises actuating the adjusting means.

20. The method of claim 15, wherein the roller shaft and guide roller assembly includes a sleeve for receiving the roller shaft and, the step of attaching the shim to the roller shaft and guide roller assembly further comprises attaching the shim to the sleeve.

* * * * *